US007874935B2

(12) United States Patent
Jertson et al.

(10) Patent No.: US 7,874,935 B2
(45) **Date of Patent: *Jan. 25, 2011**

(54) GOLF CLUB HEAD WITH REINFORCED CROWN

(75) Inventors: Marty R. Jertson, Cave Creek, AZ (US); Eric V. Cole, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/430,821

(22) Filed: Apr. 27, 2009

(65) Prior Publication Data

US 2009/0209365 A1 Aug. 20, 2009

Related U.S. Application Data

(63) Continuation of application No. 11/496,216, filed on Jul. 31, 2006, now Pat. No. 7,396,298, and a continuation of application No. 12/047,957, filed on Mar. 13, 2008, now Pat. No. 7,563,177.

(51) Int. Cl.
*A63B 53/04* (2006.01)

(52) U.S. Cl. ..... 473/332; 473/346

(58) Field of Classification Search ..... 473/324–350
See application file for complete search history.

(56) References Cited

U.S. PATENT DOCUMENTS

| | | | | |
|---|---|---|---|---|
| 4,214,754 | A | 7/1980 | Zebelean et al. | |
| 4,432,549 | A | 2/1984 | Zebelean | |
| 4,681,321 | A | 7/1987 | Chen et al. | |
| 5,067,715 | A | 11/1991 | Schmidt | |
| 5,180,166 | A | 1/1993 | Schmidt et al. | |
| 5,213,328 | A | 5/1993 | Long et al. | |
| 5,351,958 | A | 10/1994 | Helmstetter et al. | |
| 5,419,559 | A | 5/1995 | Melanson et al. | |
| 6,595,871 | B2 | 7/2003 | Sano | |
| 6,645,087 | B2 | 11/2003 | Yabu | |
| 6,783,465 | B2 | 8/2004 | Matsunaga | |
| 6,852,038 | B2 | 2/2005 | Yabu | |
| 7,250,007 | B2 | 7/2007 | Lu | |
| 7,396,298 | B2 * | 7/2008 | Jertson et al. | 473/346 |
| 7,563,177 | B2 * | 7/2009 | Jertson et al. | 473/332 |
| 2002/0065147 | A1 | 5/2002 | Sano et al. | |
| 2003/0114244 | A1 | 6/2003 | Matsunaga | |
| 2004/0266551 | A1 | 12/2004 | Noguchi et al. | |
| 2005/0049081 | A1 | 3/2005 | Boone | |

FOREIGN PATENT DOCUMENTS

| | | |
|---|---|---|
| CN | 2636914 | 9/2004 |
| JP | 2001095957 | 4/2001 |
| JP | 2003159354 | 6/2003 |
| JP | 2005312942 | 11/2005 |

* cited by examiner

*Primary Examiner*—Alvin A Hunter

(57) ABSTRACT

A golf club head with reinforced crown is described herein. Other embodiments are also disclosed herein.

19 Claims, 2 Drawing Sheets

GOLF CLUB HEAD WITH REINFORCED CROWN

CLAIM OF PRIORITY

This application is a continuation of U.S. patent application Ser. No. 12/047,957, filed on Mar. 13, 2008, which is a continuation of U.S. Pat. No. 7,396,298, filed on Jul. 31, 2006. The contents of the disclosures listed above are incorporated herein by reference.

TECHNICAL FIELD

The present invention generally relates to golf equipment and, more particularly, to golf club heads.

BACKGROUND

Modern wood-type golf club heads are now almost exclusively made of metal rather than the persimmon wood that gave the clubs their name. These club heads are generally constructed as a hollow metal shell with a relatively thick face to withstand the ball impact and a relatively thick sole to withstand grazing impact with the ground as well as lowering the center of gravity of the club head. The remainder of the club head is manufactured as thin as possible so as to allow the maximum amount of material to be dedicated to the face and sole portions. Although the crown and skirt of a modern club head are quite thin, they still must be sufficiently rigid in the direction of the maximum stress in order to provide support for the face of the club head.

Ribs have commonly been employed in the crowns of club heads to enable the crowns to be as lightweight as possible while still providing sufficient stiffness in the fore and aft direction. U.S. Pat. No. 4,214,754 to Zebelean discloses a hollow club head with a crown that includes parallel ribs running perpendicular to the face of the club head that extend internally and bridge the thin transition with the crown. Similarly, U.S. Pat. No. 6,595,871 to Sano discloses a hollow club head with a separately attached face and a crown that includes a plurality of parallel ribs extending perpendicular to the face. U.S. Pat. No. 5,067,715 to Schmidt et al discloses a hollow club head that includes a crown with a plurality of parallel ribs that merge into and run perpendicularly to the club head face as well as a plurality of ribs that merge into and run perpendicularly to a rear wall of the club head.

The prior art fails to recognize is that a club head having a crown with parallel ribs that uniformly reinforce the face of the club head is not an efficient structure since the club head face is not uniformly loaded but is subjected to essentially a point impact near its center.

DESCRIPTION

Figure 1:
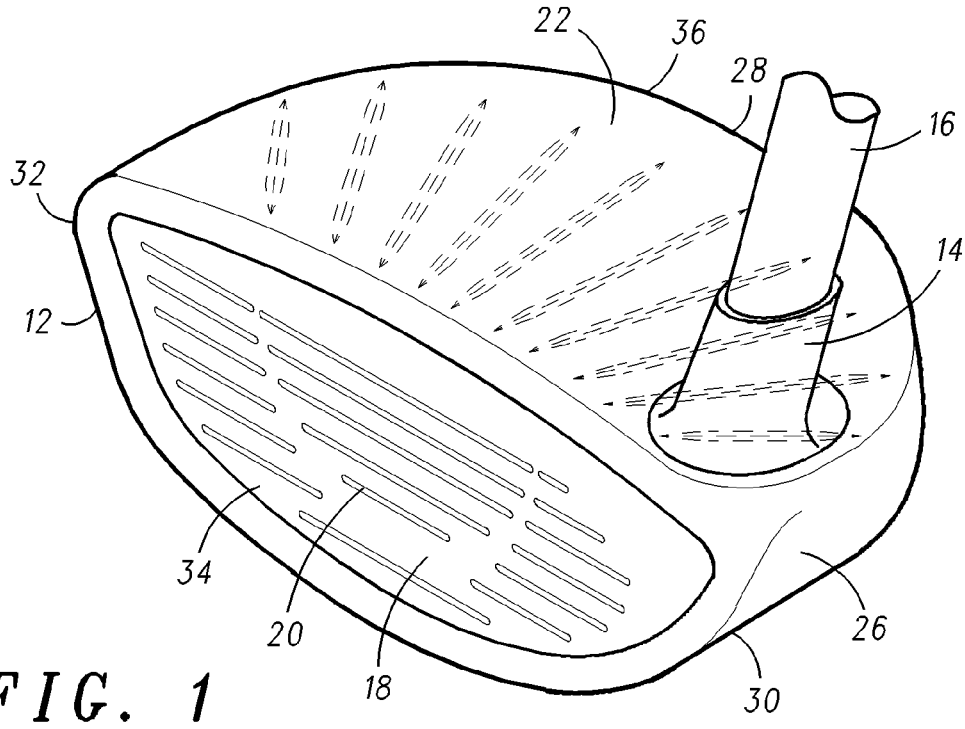
FIG. 1 is a front perspective view of a golf club head incorporating features of the present invention.
Figure 3:
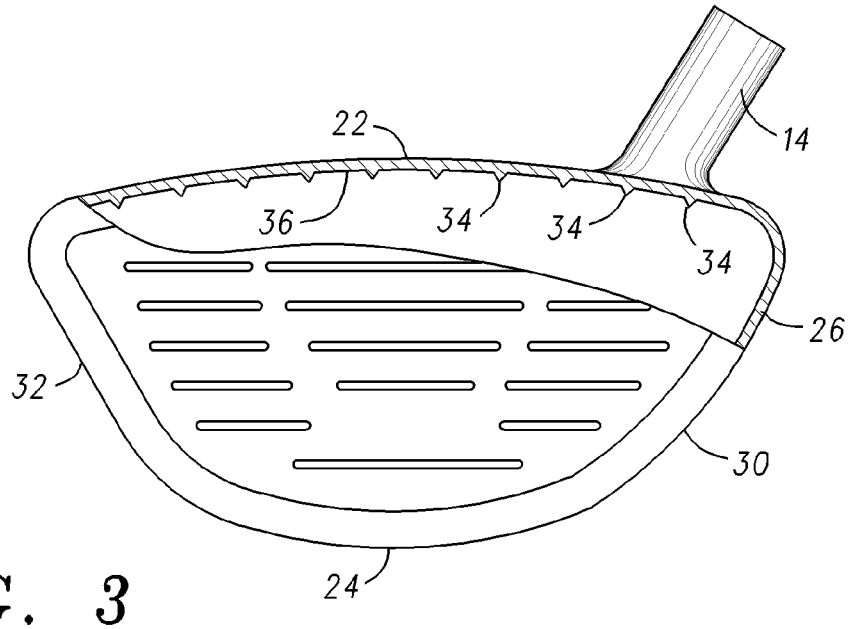
FIG. 3 is a partial cross-sectional view of the club head of FIG. 1 viewed from the front.
Figure 2:
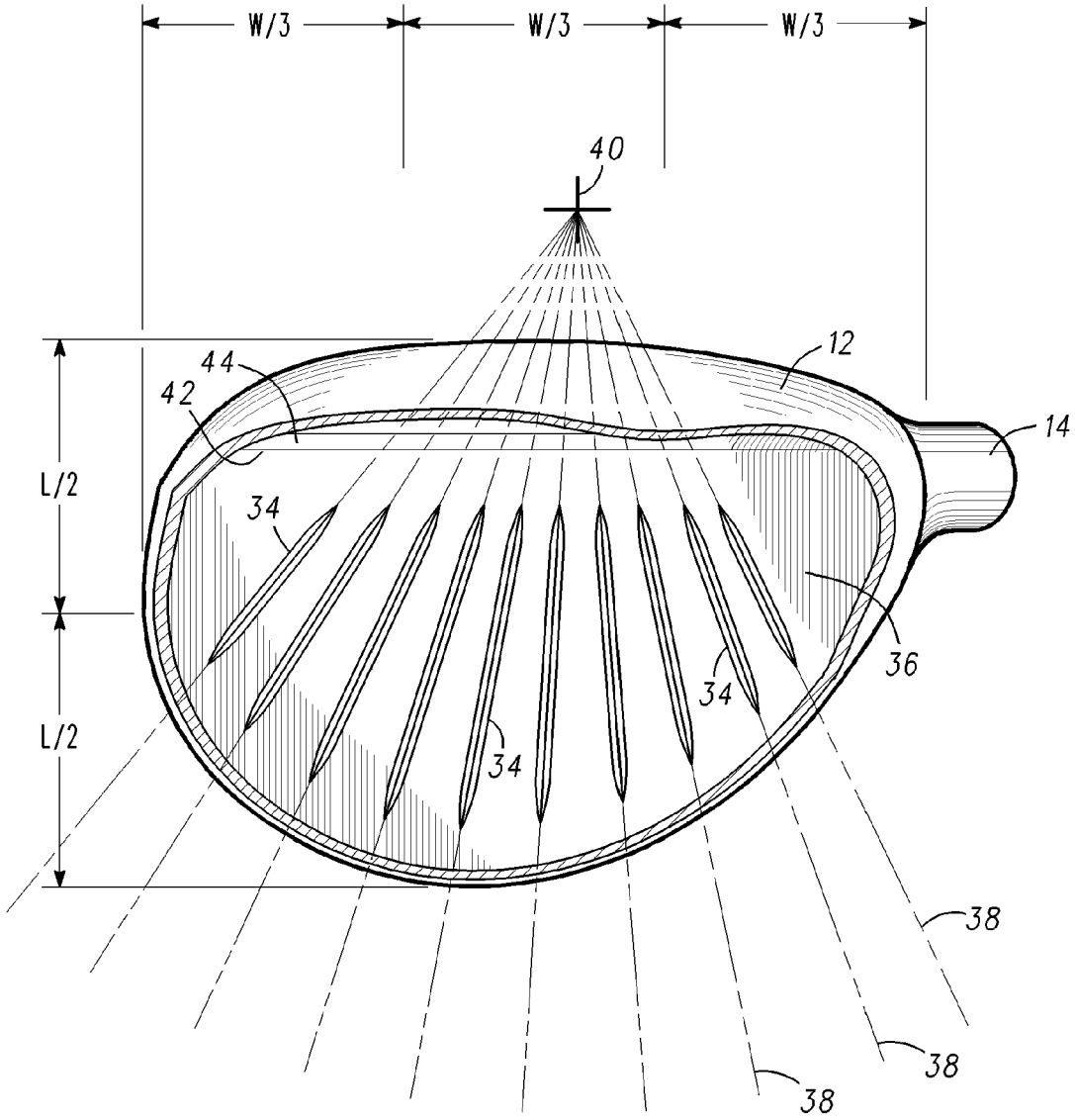
FIG. 2 is a cross-sectional view of the club head of FIG. 1 viewed from below.

With reference to FIGS. 1-3, golf club 10 comprises a club head 12, a hosel 14 and a shaft 16. Club head 12 is composed of a hollow body 18, typically made of stainless steel, titanium or other material having a high shear modulus of elasticity and high strength-to-weight ratio. Hollow body 18 comprises a front wall or face 20 adapted for impacting a golf ball. Hollow body 18 further comprises a top wall or crown 22, a bottom wall or sole 24, and a side wall or skirt 26 that connects the face 20 to crown 22 and sole 24. Club head 12 further includes a heel end 30 and a toe end 32. Skirt 26 wraps around the club head 12 between the heel and toe ends 30, 32 to form a rear wall 28.

Crown 22 comprises a thin walled structure preferably cast as part of hollow body 18. Crown 22 is preferably titanium having a relatively thin thickness dimension of 0.030 inch.+−.0.005 inch. Crown 22 is reinforced with a plurality of ribs 34 extending downward from lower surface 36 of crown 22. Each rib 34 extends from a first end proximal, but spaced from, the front wall 20 to a second end proximal, but spaced from, the rear wall 28. The ribs 34 are spaced apart by a greater amount, preferably 20% greater, at their second ends than at their first ends. Adjacent ribs 34 diverge from their first ends toward their second ends by an angle of at least 5 degrees. Ribs 34 comprise narrow, elongate, generally straight, metallic, shock wave distributing elements with a height dimension of 0.020 inch.+−.0.005 inch and width dimension of 0.070 inch.+−.0.005 inch. Ribs 34 are generally convex downward when viewed in cross-section and blend smoothly into lower surface 36 of crown 22. It will be understood that crown 22 is free of ribs extending transversely between the ribs 34.

The lower surface 36 of the crown 22 has a forward portion and a rearward portion as defined by a midline lying generally parallel to the front wall 20 one-half the distance between a forwardmost point on the front wall 20 and a rearwardmost point on the rear wall 28. The first ends of the ribs 34 terminate in the forward portion of the crown 22 and the second ends of the ribs 34 terminate in the rearward portion of the crown 22.

As shown most clearly in FIG. 2, ribs 34 are arrayed in a pattern such that the longitudinal axes 38 of the ribs 34 radiate from and intersect at a point 40 in space located forward of front wall 20. Point 40 is preferably located within the middle one third (W/3) of the width of front wall 20 and is preferably located substantially in front of the center line of front wall 20. Note that because club head 12 is a three dimensional body, as used herein, point 40 refers to a single point when viewed in plan view as in FIG. 2. Alternatively, point 40 can be thought of as a vertical line consisting of the locus of intersections of vertical planes passing through the center lines of the ribs 34.

Ribs 34 originate at a first location proximal the intersection 42 of the rear surface 44 of front wall 20 and lower surface 36 of crown 22 and extend to a second location proximal rear wall 28. In the illustrative embodiment, at least half, and preferably all of the ribs 34 extend from front wall 20 past the mid-point (L/2) of club head 12 and are not interconnected by any transverse ribs. Accordingly, each rib 34 acts independently of the other ribs 34 interconnected only by the intervening thin section of crown 22 therebetween. Preferably, point 40 is also no more than L/2 forward of front wall 20. This results in a pattern of ten ribs 34 subtending an angle of approximately 60 degrees or an angular divergence of from 4 to 8 degrees, preferably about 6 degrees of divergence between adjacent ribs 34.

The surprising result of this arrangement of ribs 34 is that although an array of perpendicular ribs 0.020 inch high by 0.070 inch wide results in only a 9% reduction in maximum stress as compared with unreinforced crown region, ribs 34 arranged in a radial fan pattern in accordance with the present invention reduce maximum stress in the crown region by almost 36%. Although not wishing to be held to any particular theory of operation, it is believed that because the face 20 itself deforms non-uniformly extending outward from the point of impact, the loads are transferred to the crown region in a similar non-uniform manner radiating outward from the point of impact. Therefore, arranging the ribs 34 in a radial pattern extending out from near the point of impact yields a crown 22 that more efficiently supports the face 20 during impact.

Although certain illustrative embodiments and methods have been described herein, it will be apparent from the foregoing disclosure to those skilled in the art that variations and modifications of such embodiments and methods may be made without departing from the spirit and scope of the invention. Accordingly it is intended that the invention should be limited only to the extent required by the appended claims and the rules and principles of applicable law.

The invention claimed is:

1. A golf club head comprising:

a golf club head body having a heel end, a toe end, a crown, a sole, a front surface and a rear surface; and a plurality of generally straight ribs protruding along a surface of the crown;

wherein:

each rib of the plurality of generally straight ribs comprises:

a first end portion towards the front surface of the golf club head body; and a second end portion towards the rear surface of the golf club head body;

at least two ribs of the plurality of generally straight ribs comprise at least two longitudinal axes that intersect at a common point forward of the front surface;

the first end portion of at least one rib of the plurality of generally straight ribs blends into the crown towards the front surface;

the second end portion of the at least one rib of the plurality of generally straight ribs blends into the crown towards the rear surface; and distances separating rear ends of adjacent non-intersecting ribs of the plurality of generally straight ribs are greater than distances separating front ends of the adjacent non-intersecting ribs of the plurality of generally straight ribs.

2. The golf club head of claim 1, wherein:

the crown is free of one or more ribs extended transversely between the plurality of generally straight ribs.

3. The golf club head of claim 1, wherein:

the first end portion of each rib is spaced from the front surface; and the second end portion of each rib is spaced from the rear surface.

4. The golf club head of claim 1, further comprising:

a shaft coupled to a hosel of the golf club head body.

5. The golf club head of claim 1, wherein:

the surface of the crown comprises a forward portion and a rearward portion;

a midline between the forward and rearward portions lies generally parallel to the front surface of the golf club head body at substantially one-half a distance between a forwardmost point at the front surface and a rearwardmost point at the rear surface;

the first end portion of each rib of the plurality of generally straight ribs lies at the forward portion; and the second end portion of each rib of the plurality of generally straight ribs lies at the rearward portion.

6. The golf club head of claim 1, wherein:

a distance between two ribs of the plurality of generally straight ribs is greater than a width dimension of one of the plurality of generally straight ribs.

7. The golf club head of claim 1, wherein:

a thickness dimension of the crown is greater than a height dimension of at least one of the plurality of generally straight ribs.

8. The golf club head of claim 1, wherein:

a thickness dimension of the crown is less than a width dimension of at least one of the plurality of generally straight ribs.

9. The golf club head of claim 1, wherein:

at least one generally straight rib of the plurality of generally straight ribs is concave relative to the sole of the golf club head body.

10. The golf club head of claim 1, wherein:

dimensions of the golf club head comprise at least one of:

a crown thickness dimension of approximately 0.030 inch;

a rib width dimension of approximately 0.070 inch; or a rib height dimension of approximately 0.020 inch.

11. The golf club head of claim 1, wherein:

each rib of the plurality of generally straight ribs comprises a substantially continuous rib height between the first end portion and the second end portion.

12. The golf club head of claim 1, wherein:

each rib of the plurality of generally straight ribs comprises a substantially constant rib width between the first end portion and the second end portion.

13. The golf club head of claim 1, wherein:

each rib of the plurality of generally straight ribs protrudes inward towards the sole of the golf club head body.

14. A golf club head comprising:

a golf club head body having a heel end, a toe end, a crown, a sole, a front surface and a rear surface; and a plurality of generally straight ribs protruding along a surface of the crown;

wherein:

each rib of the plurality of generally straight ribs comprises:

a first end portion towards the front surface of the golf club head body; and a second end portion towards the rear surface of the golf club head body;

all ribs of the plurality of generally straight ribs comprise longitudinal axes that intersect at a common point forward of the front surface;

the first end portion of at least one rib of the plurality of generally straight ribs blends into the crown towards the front surface; and the second end portion of the at least one rib of the plurality of generally straight ribs blends into the crown towards the rear surface.

15. A golf club head comprising:

a body having a heel end, a toe end, a crown, a sole, a front surface and a rear surface; and a plurality of generally straight ribs extending towards the sole from an inner surface of the crown;

wherein:

the plurality of generally straight ribs are non-intersecting;

the plurality of generally straight ribs comprises a first rib closest to the heel end and a second rib closest to the toe end; and the plurality of generally straight ribs are arranged in a substantially radial pattern to form a fan-like shape between the first and second ribs.

16. The golf club head of claim 15, wherein:

the plurality of generally straight ribs comprise an angular divergence from each other of between approximately 4 degrees to approximately 8 degrees.

17. The golf club head of claim 15, wherein:

each of the one or more of the plurality of generally straight ribs comprises a front end portion, a rear end portion, and a rib body between the front and rear end portions; and the rib body of one or more of the plurality of generally straight ribs comprises at least one of:

a substantially constant rib width; or a substantially continuous rib height.

18. The golf club head of claim 15, wherein:

a distance between two ribs of the plurality of generally straight ribs is greater than a width dimension of one of the plurality of generally straight ribs.

19. The golf club head of claim 15, wherein:

at least one generally straight rib of the plurality of generally straight ribs is concave relative to the sole.

* * * * *